United States Patent [19]

Goldfarb et al.

[11] 3,946,517

[45] Mar. 30, 1976

[54] ANIMAL CHARACTERIZATION FIGURES WITH ARTICULATABLE BODY COMPONENTS

[75] Inventors: Adolph E. Goldfarb, Tarzana; Erwin Benkoe, Encino; Delmar K. Everitt, Woodland Hills; Ronald F. Chesley, La Crescenta; Richard D. Frierdich, Canoga Park, all of Calif.

[73] Assignees: Adolph E. Goldfarb, Tarzana; Erwin Benkoe, Encino, both of Calif.

[22] Filed: Feb. 13, 1975

[21] Appl. No.: 549,826

[52] U.S. Cl. ..... 46/21; 46/161

[51] Int. Cl.[2] ..... A63H 3/16

[58] Field of Search ..... 46/21, 22, 151, 161, 173

[56] References Cited

UNITED STATES PATENTS

| | | | |
|---|---|---|---|
| 2,663,971 | 12/1953 | Ippolito | 46/161 |
| 2,752,726 | 7/1956 | Calverley | 46/22 |
| 3,874,113 | 4/1975 | Beck | 46/22 |

*Primary Examiner*—Russell R. Kinsey
*Assistant Examiner*—Robert F. Cutting
*Attorney, Agent, or Firm*—Robert M. Ashen; Robert J. Schaap

[57] ABSTRACT

An animal characterization for preschool children which may adopt a toy figure of unique design having articulated body components, as for example, the head, arms and legs. This character can be dressed or decorated to depict various occupations or professions or activities. In essence, the character figure includes first and second mating torso sections which are secured together to form a torso. Apertures in the torso accommodate articulatable arms and the torso section is also designed to accommodate articulatable legs. Feet may be provided with respect to each of the legs and movable with respect to the legs. Hands may also be provided for articulatable movement with respect to the arms. Finally, a head section is pivotally mounted on the torso and may be provided with any of a number of hats in order to depict a certain profession or activity or occupation.

7 Claims, 12 Drawing Figures

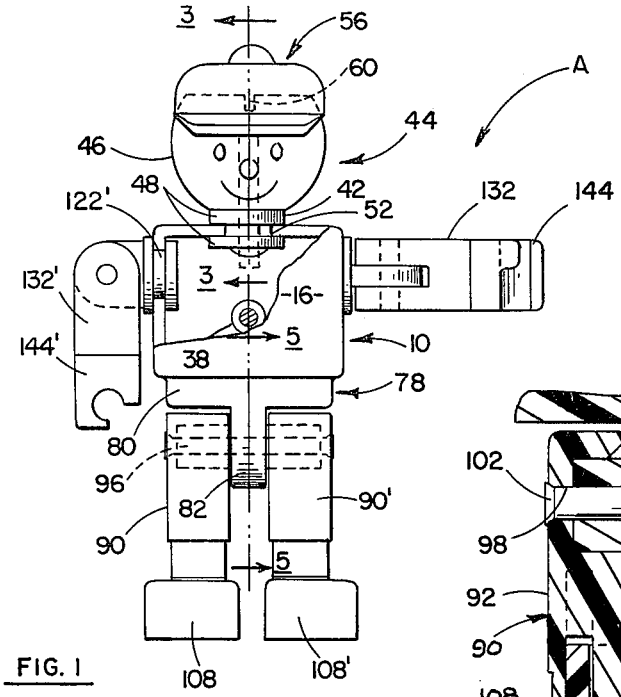
FIG. 1
FIG. 2
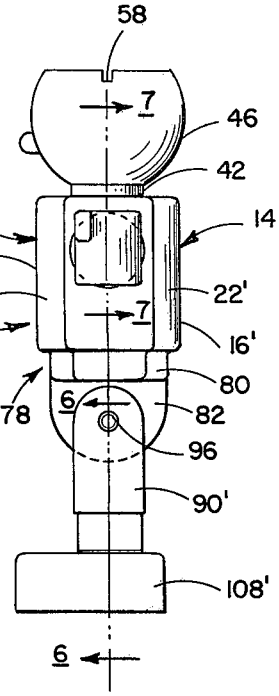
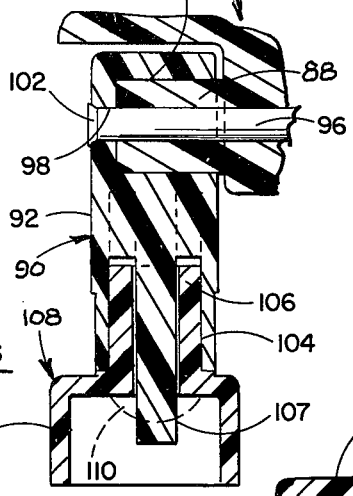
FIG. 6
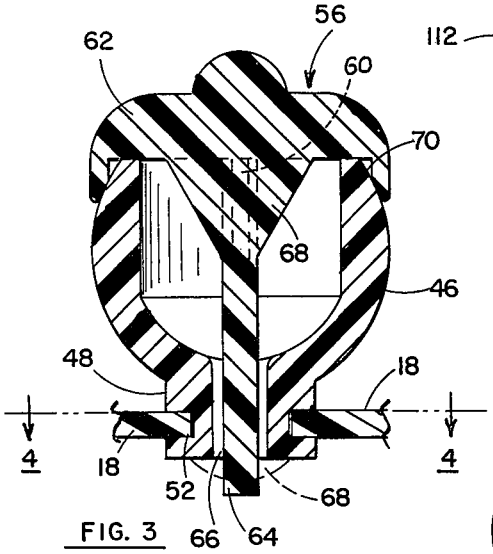
FIG. 3
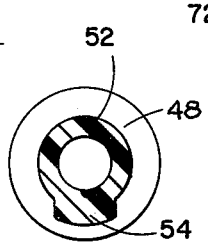
FIG. 4
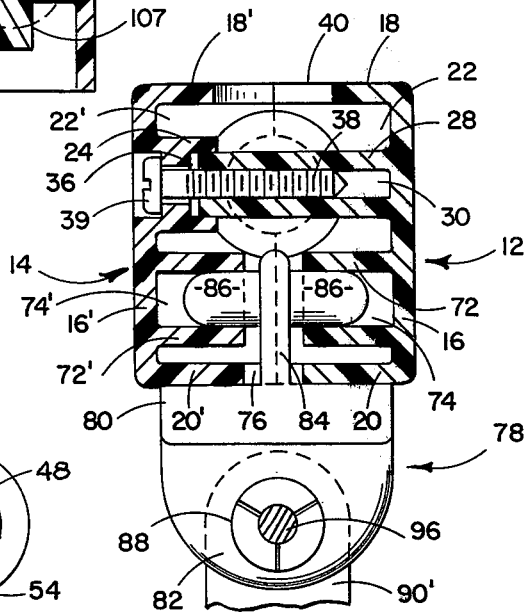
FIG. 5
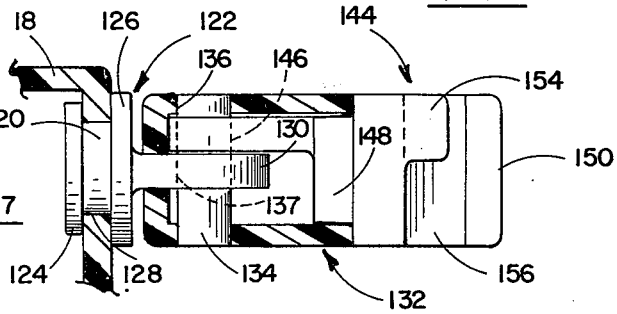
FIG. 7

ANIMAL CHARACTERIZATION FIGURES WITH ARTICULATABLE BODY COMPONENTS

BACKGROUND OF THE INVENTION

This invention relates in general to certain new and useful improvements in animal characterizations and, more particularly, to character figures having articulatable body components.

There are a number of commercially available toy characters which include a torso portion having movable arms and legs. Generally, these toy character figures are designed for preschool children. More specifically, the manufacturers of such character figures produce each individual character with a specific design to depict a certain occupation or activity. Consequently, when it is desired to produce a similar character of modified activity or occupation, it is necessary to produce an entirely new character figure.

Another serious drawback of these commercially available characterization figures is that the various extremities, such as the arms and legs, are connected to a torso section in such manner that they are capable of being easily removed, and this is particularly pronounced when the extremities are pivotally secured. In this case, it has been observed that it is necessary to secure the extremities to the torso with at least a 25-pound pull resistance in order to prevent preschool children from pulling the extremities from the torso section of the figure. However, most of the commercially available characterization figures cannot be designed in order to provide this resistive force and which thereby leads to an inherent disadvantage from a safety point.

In recent years, there have been several regulations and social pressures regarding the safety of such characterization figures, due to the fact that preschool children often remove the extremities of such characterization figures and may attempt to swallow such various components which leads to severe injury to the children.

In order to overcome this problem, various manufacturers of preschool characterization figures have attempted to resort to production of such characters which are essentially integral in their structure and thereby prohibit articulatable movement of the various extremities on the torso section of the body. Even moreso, in order to comply with various safety regulations, the producers of these figures have resorted to increased thickness of the body components, thereby leading to increased costs.

The present invention obviates these and other problems in the provision of a toy characterization figure for preschool children with the extremities connected to the body so as to resist being pulled from the body or torso. In essence, the present invention provides a two-piece torso with the extremities having connector sections at their inner ends which fit within apertured portions in the torso to prevent inadvertent or unauthorized removal therefrom.

It is therefore the primary object of the present invention to provide a unique toy animal characterization figure with articulatable body components which are effectively incapable of being removed by preschool children.

It is another object of the present invention to provide an animal characterization figure of the type stated which can be constructed by conventional plastic molding techniques at relatively low costs.

It is a further object of the present invention to provide animal characterization figures with articulatable body components, of the type stated, which include first and second mating torso sections and which are provided with apertures to receive extremities in such manner that they are relatively incapable of being removed by preschool children.

It is another salient object of the present invention to provide a method of producing animal characterization figures with articulatable body components and which characterization figures are highly safe for preschool children.

With the above and other objects in view, our invention resides in the novel features of form, construction, arrangement and combination of parts presently described and pointed out in the claims.

SUMMARY OF THE DISCLOSURE

A toy characterization figure in the form of a two-legged upright animal which is uniquely designed with articulatable body components. These body components are secured to a torso of the figure in such manner that they cannot be pulled from the torso without at least a 25-pound pull force and which is generally in excess of the amount of force capable of being exerted by a preschool child.

In accordance with the present device, the toy characterization figure comprises a pair of mating torso sections which are capable of being secured together by a single fastening means, such as a screw, in order to form a body torso. The two torso sections are each provided with opposed semi-circular apertures so that a complete aperture generally circular in shape is formed in the torso when the torso sections are secured together.

An individual connector means or connector section is capable of being secured in each of these apertures. Each of these connector sections comprise a pair of opposed flanges separated by a wall of reduced diameter, thereby presenting an annular groove. The annular groove is capable of fitting within the apertures with the flanges disposed on each of the opposite sides thereof in order to retentively hold these connector sections in the apertures.

The connector sections are each provided with outwardly extending flanges in order to secure arm sections. The arm sections are formed of a hollow shell with a pair of projecting flanges which are capable of being aligned in registration with the flange on the connector section.

Another unique feature of the present device is that a hand may be secured to each of the connector sections along with the arm section. This hand is also provided with a projected flange which extends through an enlarged central aperture in the shell. This flange on the hand has a portion which lies in registration with the flanges on the arm and the flange on the connector section. Each of these flanges is provided with aligned apertures in order to accommodate a pin.

The hand, mentioned above, is formed of a material which has a different resiliency characteristic than the arm. Inasmuch as it would otherwise be difficult to adequately secure the hand to the arm by any conventional techniques, such as adhesives, the above outlined arrangement enables rigid securement of the hand with respect to the arm and to the connector section. In this way the arms and the associated hands can be rotated on the connector section in a plane relative to the transverse dimension of the torso. Moreover, the arms can be rotated on the connector sections in planes which are perpendicular to the transverse dimension of the torso.

The hands are constructed in such manner that they provide a finger-forming section and a thumb section which are separated by an object receiving aperture. Inasmuch as the thumb section and the finger-forming section are resilient, they can be separated somewhat in order to insert an object into this object receiving aperture.

The present device also provides an elongated slot on the lower face of the torso which is capable of receiving a pelvic section. The pelvic section is provided with a pair of outwardly extending bosses in order to secure a pair of legs. The lower ends of the legs are provided with enlarged recesses in order to rotatably receive feet sections.

A head may be rotatably secured to the torso by a connector section like that by which the arms are secured.

Another one of the unique aspects of the present device is that the feet are oversized with respect to the legs when compared to the feet and the legs of a normal human being. In this way, one of the legs is capable of being pivoted outwardly in a somewhat suspended position and the foot on the other leg is capable of being turned inwardly perpendicular to the normal swingable movement of the leg in order to support the figure in an upright position.

BRIEF DESCRIPTION OF THE DRAWINGS

Figure 8:
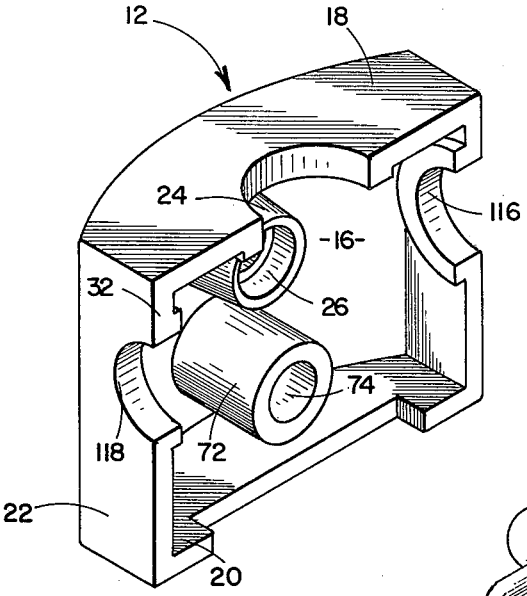
Figure 9:
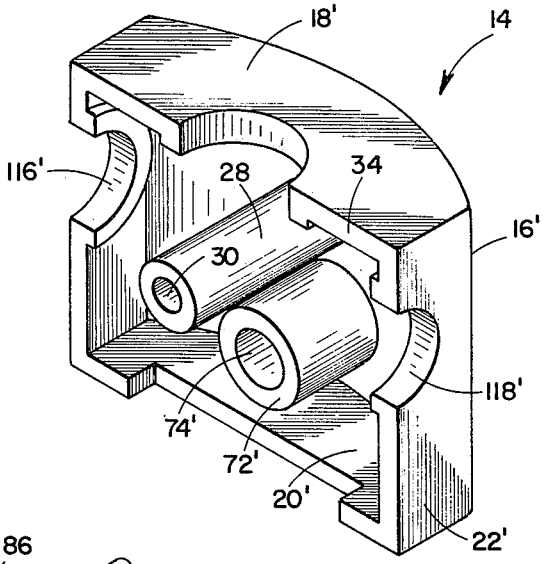
Figure 10:
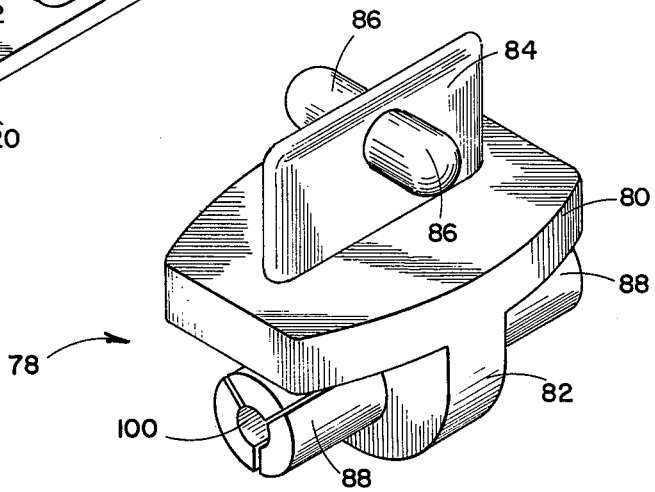
Figure 12:
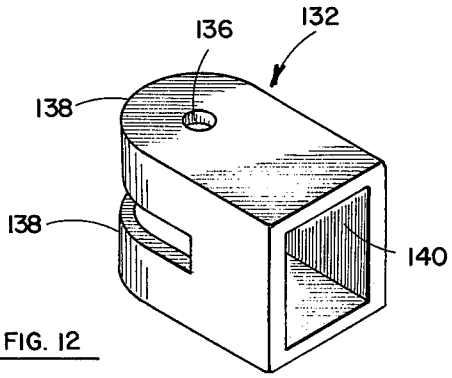
Figure 11:
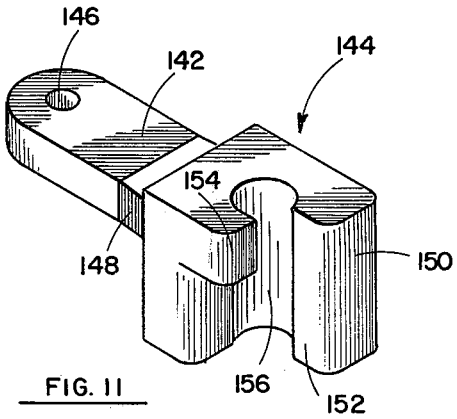

Having thus described the invention in general terms, reference will now be made to the accompanying drawings in which:

FIG. 1 is a front elevational view of an animal characterization figure with articulatable body components constructed in accordance with and embodying the present invention, partially broken away and in section;

FIG. 2 is a side elevational view of the animal characterization figure of FIG. 1;

FIG. 3 is a fragmentary vertical sectional view taken along line 3—3 of FIG. 1;

FIG. 4 is a fragmentary horizontal sectional view taken along line 4—4 of FIG. 3;

FIG. 5 is a vertical fragmentary sectional view taken along line 5—5 of FIG. 1;

FIG. 6 is a fragmentary vertical sectional view taken along line 6—6 of FIG. 2;

FIG. 7 is a fragmentary vertical sectional view taken along line 7—7 of FIG. 2;

FIG. 8 is a perspective view showing the interior portion of a front torso section forming part of the characterization figure of the present invention;

FIG. 9 is a perspective view showing the interior portion of the rear torso section forming part of the characterization figure of the present invention;

FIG. 10 is a perspective view of a pelvic member forming part of the characterization figure of the present invention;

FIG. 11 is a perspective view of a hand which forms part of the characterization figure of the present invention; and FIG. 12 is a perspective view showing one of the arms forming part of the characterization figure of the present invention.

DETAILED DESCRIPTION

Referring now in more detail, and by reference characters to the drawings which illustrate a preferred embodiment of the present invention, A designates a toy animal characterization figure, as for example a figure having a characterization resembling a human being. In this respect, and for purposes of the present invention, it should be understood that this characterization figure A could adopt any form of two-legged upright animal characterization. Thus, in this context, the term "animal" includes all forms of animal species including human beings which can stand upright on two legs, as well as two-legged upright mechanical figures such as robots and the like.

The characterization figure A generally comprises a torso 10 having a front torso section 12 and a rear torso section 14 which are designed and sized to be mated together in a manner to be hereinafter described. The front torso section 12 includes a vertical front wall 16 having top and bottom walls 18 and 20, along with integrally formed connecting vertically disposed side walls 22.

The rear torso section 14 similarly includes a vertically disposed rear wall 16' having an integrally formed, inwardly-struck top and bottom walls 18' and 20', respectively, and connecting side walls 22', as more fully illustrated in FIGS. 1, 2 and 5 of the drawings.

Integrally formed with the front wall 16 on the interior portion of the front torso section 12 is an inwardly extending tubular sleeve 24 which is provided with an enlarged central aperture 26. The rear torso section 14 is also integrally provided on the interior portion of the rear wall 16' with an inwardly extending tubular sleeve 28 also having a central aperture 30. Each of the torso sections 12 and 14 is essentially rectangular in shape and are provided with opposed engageable peripheral margins 32 and 34, respectively, so that the two sections 12 and 14 are capable of being fitted together to form a complete figure torso. In this arrangement, the sleeve 28 is diametrally smaller than the sleeve 24 and is capable of extending within the central aperture 26 of the sleeve 24. In this respect, it also can be observed that the sleeve 24 is of a relatively short length and the sleeve 28 is of relatively longer length extending beyond the margin 34 of the section 12. Moreover, the sleeve 26 is provided with an annular shoulder 36 which is capable of engaging the forwardly presented margin of the sleeve 28 so that in effect the sleeve 28 bottoms out against the shoulder 36.

The two torso sections 12 and 14 can be retentively secured together after all of the extremities (to be hereinafter described) are secured to the torso 10, by means of a single screw 39 having a shank thereof extending into the aperture 30 of the sleeve 28. In this respect, the screw 39 can be threadedly secured within the sleeve 28 in order to hold the two torso sections 12 and 14 in rigid securement. In addition, it can be observed that the rear wall 16' is recessed in order to accommodate a head 40 of the screw 39.

The top walls 18 and 18' of the two torso sections 12 and 14, respectively, are provided with semicircular apertures so that when the two torso sections 12 and 14 are secured together they form an enlarged aperture 40 which is sized to receive the neck 42 of a head section 44. In this case, and by further reference to FIGS. 1 and 2 of the drawings, it can be observed that the head section 44 is provided with an enlarged head 46 having the features of a characterization figure resembling a human being painted or otherwise presented on the face portion of the head 46.

The neck 42 which is integrally formed with the head 46 is formed of a pair of spaced apart discs 48 having an annular recess 50 which is sized to engage the margins forming the aperture 40. In this way, it can be observed that when the torso sections 12 and 14 are secured together, the neck 42 is retentively held within the aperture 40. Furthermore, the annular recess 52 is formed with an outwardly extending flange 54, as more fully illustrated in FIG. 4 of the drawings, to engage against the wall forming the aperture 40. In this way, the head section 44 is snugly, but nevertheless rotatably, fitted within the aperture 40.

A headpiece 56 is secured to the upper end of the head 46. The headpiece section 56 may adopt various forms such as a hat, a hair covering or the like. Inasmuch as the device herein illustrated and described includes a headpiece in the form of a hat, the section 56 will oftentimes be referred to herein as a hat section. In this respect, it can be observed that the head 46 is relatively flat at its upper end and may be provided with a notch 58 to receive a finger 60 formed on an inner surface of the hat section 56 in order to properly align the hat section 56 with respect to the head 46. One of the unique features of the present invention is that the hat can be replaced by any of a number of hat configurations in order to present the desired appearance to the characterization figure.

The hat section 56 includes a top wall 62 having an integrally formed downwardly extending pin 64 which extends through an aperture 66 formed within the neck 42. Moreover, the pin 64 is reinforced at its upper end against the top wall 62 by means of four quadrilaterally located webs 68. After the pin 64 is inserted through the aperture 66 in the neck 42, it can be mashed or otherwise heat-formed in order to form an enlarged head 68 illustrated in dotted lines in FIG. 3. Moreover, it should also be observed that the upper margin of the head 46 is provided with a small annular extending, arcuately-shaped recess 70 in order to engage an abutting portion of the hat 56. In this way, the hat only contacts the head 44 on one continuous line around the circumference of the head.

The mating torso sections 12 and 14 are each integrally provided on their respective front and rear walls 16 and 16' with opposed tubular retaining sleeves 72 and each of which is provided with aligned apertures 74 and 74' respectively. In addition, the bottom walls 20 and 20' of each of the torso sections 12 and 14 are slotted in order to provide an elongated slot 76 when the two torso sections 12 and 14 are secured together, in the manner as illustrated in FIG. 5 of the drawings.

The characterization FIG. A also includes a pelvic section 78 which is more fully illustrated in FIG. 10 of the drawings and comprises a pelvic plate 80 having an integrally formed, vertically disposed pelvic wall 82. The plate 80 is also provided with an upstanding flange 84 which extends through the elongated slot 76 and into the interior cavity formed by the two mating torso sections 12 and 14. Moreover, the flange 84 is provided with a pair of opposed outwardly struck integrally formed pins 86 which are designed to extend into the apertures 74, 74' of each of the retaining sleeves 72 and 72'. In this way, it can also be observed that the pelvic section 78 is retentively held within the torso sections 12 and 14 when the two pieces are secured together by means of the screw 39. The pelvic section 78 is also provided with a pair of outwardly extending leg retaining tubular bosses 88 for retaining a pair of legs 90 and 90'.

The sleeves 72 and 72' are constructed so that the apertures 74 and 74' are slightly tapered outwardly, that is to the exterior of the characterization FIG. A. In this way, the pins 86 may fit within the aperture 74 and 74' in snug fitting engagement with the interior annular walls of the sleeves 72 and 72'.

The legs 90 and 90' are each substantially identical in their construction, and one of the legs 90 essentially constitutes a mirror image of the leg 90'. Hence, one of these legs 90 is more fully illustrated in FIG. 6 of the drawings and comprises an upstanding post 92 which is provided with a recess 94 at its upper end in order to accommodate one of the outwardly extending bosses 88. In like manner, the leg 90' is similarly provided with a recess in order to accommodate the other of the bosses 88. The legs 90 and 90' are retentively, but nevertheless pivotally, held on the pelvic section 78 by means of a pin 96 which extends through apertures 98 formed within the legs 90 and 90' and communicating with the central apertures 100 formed within the bosses 88. In essence, the pin 96 extends entirely through the two legs 90 and 90' and the flange 82 of the pelvic section 78, in the manner as illustrated in FIGS. 1 and 2 of the drawings. Furthermore, the pin 96 may be provided with enlarged heads 100 at each of its outer ends for retentively holding the pin in position in order to hold the legs 90 and 90' onto the pelvic section 78.

The legs 90 and 90' are each provided at their lower end with a diametrally enlarged recess or socket 104 in order to accommodate a tubular stub 106 formed on each of the pair of feet 108 and 108'. The post 92 is also provided with a downwardly extending pin 107 extending axially through the recess 104 and is fitted within a central aperture formed within the upstanding tubular stub 106. In this way, the lower end of the pin 107 which projects beyond the lower end of the post 92 may be mashed or otherwise formed to provide an enlarged head 110 as illustrated in FIG. 6 of the drawings. In this way, the feet 108 and 108' can be retentively held within the legs 90 and 90' respectively. Moreover, it can be observed that the feet also include a downwardly extending annular skirt 112 for engagement with the floor or otherwise supporting surface. In accordance with this construction, it can be observed that each of the feet 108 and 108' are pivotal within the lower recesses or sockets 104 formed within each of the legs 90 and 90'.

By reference to FIGS. 1 and 2, it can be observed that each of the feet 108 and 108' are substantially oversized with respect to the associated legs 90 and 90', and are sized such that the FIG. A can actually stand in an upright position on one foot. The feet each have a length to width ratio of 1 to 5/8. Furthermore, the length of each foot is related to the transverse dimension of the torso 10 that is from front wall 16 to back wall 16' of 1 to 7/8. The length of each of the feet is related to the overall length of the legs of the FIG. A in a ratio of 1 to 1, and the width of each of the feet is related to the length of the legs in a ratio of 5/8 to 1.

The center of gravity of the FIG. A in the upright position is such that it can be supported on one foot. Thus, if one of the legs 90 and 90' with the associated foot 108 or 108' were swung rearwardly or forwardly, and the other of the feet were rotated inwardly so that its longitudinal dimension was parallel to the width of the torso, the FIG. A would stand in the upright position.

Each of the torso sections 12 and 14 are provided near their upper ends and on opposed end walls 22 and 22' with a pair of opposed semicircular slots 116 and 116', as well as opposed semicircular slots 118 and 118', as more fully illustrated in FIGS. 8 and 9 of the drawings.

When the two torso sections 12 and 14 are secured together, these slots form enlarged circularly shaped, shoulder receiving apertures 120 (FIG. 7) on the torso 10. Only one of the apertures and the related arm construction is more fully illustrated in FIG. 7, since the opposite shoulder and related arm construction is identical thereto.

One of the shoulder receiving apertures 120 is sized to accommodate a shoulder section 122 in the form of an extremity connector and is formed by a pair of discs 124 and 126 which are separated through an annular wall extending between the discs 124 and 126 and foming an annular recess 128. The recess 128 is sized so that it is designed to snugly fit within the walls forming the aperture 120. Moreover, the discs 124 and 126 are sized so that peripheral surfaces on opposed faces thereof snugly, but rotatably, engage the interior and exterior surfaces of the components forming the torso surrounding the aperture 120.

The outermost disc 126 of the connector 122 is integrally provided with an outwardly extending flange 130 which is designed to retain an arm 132 by means of a pin 134. This pin is sized to extend between aligned apertures 136 formed in the arm 132 and an aperture 137 in the flange 130.

The other side wall of the torso section 10 is also provided with an extremity connector 122', in the form of a shoulder section, and which is similarly designed to retain an arm 132'. The shoulder section 122' and the arm 132' are respectively substantially identical to the illustrated and described shoulder 122 and arm 132.

The arm 132 is provided at the inner end thereof for attachment to the torso 10 with the inner end formed by a pair of opposed parallel and spaced apart flanges 138 which are designed to engage and receive the flange 130. In this way, when the aperture 136 in the flanges 138 and the aperture 137 in the flange 130 are aligned, the pin 134 can be inserted in order to retentively hold the arm 132 to the shoulder section 122.

In accordance with the above outlined construction, it can be observed that the connectors 122 and 122' respectively hold the arms 132 and 132' to the torso in such manner that they cannot be pulled from the torso 10 by a preschool child. In addition, the connectors 122 and 122' respectively enable the arms 132 and 132' to be rotatable in planes which are substantially parallel to the transverse dimension of the torso 10, that is in planes parallel to the side walls 22 and 22' of the torso 10. Moreover, since the arms 132 and 132' are secured to flanges 130 on the connectors 122 and 122' by means of the pins 134, the arms 132 and 132' are rotatable through arcs in planes which are substantially perpendicular to the transverse dimension of the torso 10.

The arm 132 is also provided with an elongated, rectangularly shaped aperture 140 extending therethrough which is designed to accommodate a retaining flange 142 on a hand section 144, as more fully illustrated in FIGS. 11 and 12. The retaining flange 142 is similarly provided with an aperture 146 which is designed to be marginally registered with the apertures 136 in the flanges 138 and the aperture 137 in the flange 130. Thus, the pin 134 actually fits within all of these aligned apertures so that in this way the hand section 144 can also be retentively held with the arm 132 on the shoulder section 122 by means of the pin 134. In the same respect, it should be observed that the opposite arm 132' is provided with a hand section 144' which is substantially identical in construction to the hand 144.

The hand 144 is similarly provided with an alignment block 148 located outwardly of the flange 142 and which is sized to snugly fit in the rectangularly shaped aperture 140. In this way, the hand 146 will not rotate and will be snugly and retentively held within the rectangularly shaped aperture 140 in the arm 132. The entire hand section 144 and related hand section 144' are both formed of a relatively soft plastic material which is somewhat more resilient than the plastic material forming the remaining components in the body. For this reason, the hand sections 144 and 144' are secured to the arms 132 and 132' as opposed to being integral with the arms 132 and 132'.

In accordance with this construction, it can be observed that the pin 134 serves a dual function of first holding the hand 144 to the arm 132 and simultaneously to the connector 122, even though the hand 144 is formed of a different material than the arm 132. Moreover, the arm 132 and hand 144 are rotatable about the torso 10 and nevertheless retentively held with respect thereto.

At its outer end, the hand section 144 is provided with a hand-forming block 150 having a projected finger-forming section 152 and a projected thumb 154 which are separated by an arcuately shaped recess 156. In this way, the thumb 154 can be spread somewhat from the finger-forming section 152 in order to insert an object in the recess 156 for removably, but nevertheless retentively, holding an object in this recess 156.

The characterization FIG. A of the present invention can be very easily assembled, by first inserting the pin 64 of the selected hat 56 through the aperture in the neck section 42. Thereafter, the lower end of this pin 64 is spread in order to form the head 68 and thereby retentively hold the hat 56 onto the head 46 of the head section 44. The shoulder sections 122 and 122' are then inserted within the respective apertures 120 prior to the complete assembly of the torso 10 by means of the torso sections 12 and 14.

The pelvic section 78 is located so that the pins 86 extend in their respective apertures 74 and 74'. After these components have been located in proper position, the two torso sections 12 and 14 can be urged together so that the mating opposed margins 32 and 34 are in abutting engagement. Thereafter, the screw 96 is inserted in the aligned apertures 26 and 30 and tightened in order to secure the two torso sections 12 and 14 together. In accordance with this construction, it can be observed that the shoulder sections 122 and 122' will then be rotatably, but nevertheless non-removably, located within the torso section. In like manner, the neck 42 will be rotatably, but non-removably, locked within the torso 10. In addition, it can also be observed that the pelvic section 78 is retentively and non-rotatably locked within the torso 12.

The respective hand sections 144 and 144' are then located so that the flanges 142 and the retaining block 148 are located within the elongated aperture 140 in the arms 132 and 132'. When all of the respective apertures 136 and 146 and the aperture 137 in the flange 130 are aligned, the pin 134 can then be inserted to thereby retentively lock the hand section 144 to the arm section 132 (and hence the hand section 144' to the arm section 132') and also lock these components to their respective shoulder sections 122 and 122'.

Finally, the feet sections 108 and 108' are inserted into the recess 104 formed in each of the legs 92 and 92'. The outwardly extending pin 109 is again then sealed to form the enlarged head 110 to thereby retentively hold the feet 108 and 108' on the legs 90 and 90'. Finally, the pin 96 is inserted through the respective aligned apertures in the legs and on the enlarged bosses 88 in order to retentively hold the legs 90 and 90' on the pelvic section 78.

Each of the components of the toy characterization figure can be constructed of any of a number of moldable plastics including polyethylene, polystyrene, polybutydiene and various vinylidene copolymers. Any of a number of conventional plastic molding operations may be used to form each of the respective components at a relatively low cost. One of the important aspects of the present invention is that each of these components can be very easily assembled in a minimum amount of time in order to construct the characterization figure. Notwithstanding, the characterization figure is uniquely designed so that it meets all the required safety ordinances and laws and cannot be inadvertently disassembled by a preschool child.

Thus, there has been illustrated and described a unique and novel toy characterization figure which meets all of the objects and advantages sought therefor. It should be understood that many changes and modifications and other uses and applications could be made in the toy characterization figure after reviewing this specification and the accompanying drawings. Therefore, any and all such changes, modifications and other uses and applications are deemed to be covered by the invention which is limited only by the following claims.

Having thus described our invention, what we desire to claim and secure by letters patent is:

1. A toy figure for preschool children with extremities connected to a body of said figure to resist unauthorized removal by said preschool children, said figure comprising:

a. a first torso section formed of a rigid material, b. a second torso section formed of a rigid material, c. said torso sections having abutting margins to be secured together to form a torso, d. said torso having at least one extremity retaining aperture, e. a connector section fitted in said aperture where an extremity is to be retained, f. said connector section having a pair of opposed flanges connected by a circular intermediate recessed portion sized to be fitted in said aperture, with one of said opposed flanges on each side of said aperture, and g. an extremity pivotally connected to and extending from said connector section, in such manner that said connector section can be pivoted in said aperture in a first plane relative to said torso and said extremity can be pivoted on said connector section in a second plane relative to said torso, said first and second planes being substantially mutually perpendicular, with said first plane being relatively parallel to a transverse dimension of said torso, said torso being provided with a second extremity retaining aperture, a second connector section for retention within said second aperture for pivotal movement in said first plane, and a second extremity connected to said second connector section for pivotal movement in said second plane, said first and second apertures being located on opposite sides of said torso, said first and second connector sections forming shoulder joints, and said first and second extremities comprising arms, a slot being formed in said torso, a pelvic section having an outwardly extending locking element extending through said slot and being retentively retained in said torso when said torso sections are secured together for non-pivotal movement with respect to said torso.

2. The toy figure of claim 1 further characterized in that said locking element is provided with at least one outwardly extending pin, and one of said torso sections is provided with tubular boss sized to retentively receive said locking pin.

3. The toy figure of claim 1 further characterized in that a pair of legs are secured to said pelvic section by means of a leg retaining pin.

4. The toy figure of claim 3 further characterized in that a foot section is pivotally secured to a free end of each of said legs.

5. A toy characterization figure having a body, a somewhat rigid arm comprising an outer shell and having an enlarged central aperture extending through said shell, an arm flange projecting from a first end of said shell, a hand section formed of a material having a greater resiliency than said arm, said hand comprising a hand forming member, a hand flange on said hand forming member extending into said enlarged central aperture to retentively hold said hand forming member at a second end of said shell, said hand flange extending through said enlarged central aperture and having a portion thereof disposed in substantially registered relationship with said arm flange, and connecting means to secure said flanges to said body, the connecting means being a connector which secures the arm and hand flanges with respect to the body to permit pivotal movement of the arm and hand in first and second substantially mutually perpendicular planes with respect to the body.

6. A toy characterization figure having a body, a somewhat rigid arm comprising an outer shell and having an enlarged central aperture extending through said shell, an arm flange projecting from a first end of said shell, a hand section formed of a material having a greater resiliency than said arm, said hand comprising a hand forming member, a hand flange on said hand forming member extending into said enlarged central aperture to retentively hold said hand forming member at a second end of said shell, said hand flange extending through said enlarged central aperture and having a portion thereof disposed in substantially registered relationship with said arm flange, and connecting means to secure said flanges to said body, the connecting means being a connector having an outer wall capable of being retained in a member receiving aperture in said body, a connector flange extending toward and being capable of being substantially registered with said hand and arm flanges, and pin means to secure each of said flanges together.

7. The toy characterization figure of claim 6 further characterized in that said shell of said arm is provided with a pair of spaced apart arm flanges.

* * * * *